US006321945B1

(12) United States Patent
Girouard et al.

(10) Patent No.: US 6,321,945 B1
(45) Date of Patent: Nov. 27, 2001

(54) COMPACT MOTOR DRIVEN DISPENSER

(76) Inventors: Gaston Girouard; Elinor Girouard, both of 578 Hallmark Drive, Waterloo, Ontario (CA), N2K-3P2

( * ) Notice: Subject to any disclaimer, the term of this patent is extended or adjusted under 35 U.S.C. 154(b) by 0 days.

(21) Appl. No.: 09/904,757

(22) Filed: Jul. 13, 2001

(51) Int. Cl.[7] ..... B65D 5/66; B67D 5/42
(52) U.S. Cl. ..... 222/113; 222/333; 222/392
(58) Field of Search ..... 222/113, 180, 222/333, 391, 392, 157, 326

(56) References Cited

U.S. PATENT DOCUMENTS

| | | |
|---|---|---|
| D. 361,247 | 8/1995 | Snetting et al. . |
| 4,024,994 | 5/1977 | Davis, Jr. . |
| 4,180,187 | 12/1979 | Ben-Haim . |
| 4,306,671 | 12/1981 | Fisher . |
| 5,064,098 * | 11/1991 | Hutter, III et al. ..... 222/392 |
| 5,503,307 | 4/1996 | Wilson et al. . |
| 5,815,925 | 10/1998 | Chang . |

* cited by examiner

*Primary Examiner*—Philippe Derakshani

(57) ABSTRACT

A compact motor driven dispenser for dispensing caulking and glue material includes a housing having a barrel portion and a handle portion. The barrel portion includes a top wall, a bottom wall, a back wall, a front wall, a first side wall and a second side wall. The front wall has an opening therein. The top wall has an inner surface having a track mounted thereon. A collapsible push rod is positioned in the housing and has a first end and a second end. The second has a head thereon. The push rod is extendably positioned between the track and the top wall such that the push rod abuts the back wall and the second end of the rod extends toward the front wall of the housing in a generally U-shaped configuration. A motor is positioned in the housing and in communication with the teeth of the push rod.

15 Claims, 7 Drawing Sheets

COMPACT MOTOR DRIVEN DISPENSER

BACKGROUND OF THE INVENTION

1. Field of the Invention

The present invention relates to motor driven dispensers and more particularly pertains to a new compact motor driven dispenser for dispensing caulking and glue material.

2. Description of the Prior Art

The use of motor driven dispensers is known in the prior art. More specifically, motor driven dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,306,671; 4,180,187; U.S. Des. Pat. No. 361,247; U.S. Pat. Nos. 5,815,925; 5,503,307; and U.S. Pat. No. 4,024,994.

While these devices fulfill their respective, particular objectives and requirements, the aforementioned patents do not disclose a new compact motor driven dispenser. The inventive device includes a housing having a barrel portion and a handle portion. The barrel portion includes a top wall, a bottom wall, a back wall, a front wall, a first side wall and a second side wall. The front wall has a generally circular shaped opening therein. The top wall has an inner surface having a track mounted thereon. A collapsible push rod is positioned in the housing and has a first end and a second end. The second has a head thereon. The push rod includes a plurality of discrete blocks having a top surface, a bottom surface, a back surface, a front surface and a pair of lateral surfaces. Each of the back surfaces has a saddle integrally attached thereto. Each of the front surfaces has boss thereon. Each of the bosses is positioned in and pivotally coupled to one of the saddles such that the blocks are hingedly coupled to each other. The bottom surfaces each have teeth thereon. The push rod is extendably positioned between the track and the top wall such that the push rod abuts the back wall and the second end of the rod extends toward the front wall of the housing in a generally U-shaped configuration. A motor is positioned in the housing. A plurality of drive gears is mechanically coupled to the motor and in communication with the teeth of the push rod. An actuator selectively turns the motor on or off.

In these respects, the compact motor driven dispenser according to the present invention substantially departs from the conventional concepts and designs of the prior art, and in so doing provides an apparatus primarily developed for the purpose of dispensing caulking and glue material.

SUMMARY OF THE INVENTION

In view of the foregoing disadvantages inherent in the known types of motor driven dispensers now present in the prior art, the present invention provides a new compact motor driven dispenser construction wherein the same can be utilized for dispensing caulking and glue material.

The general purpose of the present invention, which will be described subsequently in greater detail, is to provide a new compact motor driven dispenser apparatus and method which has many of the advantages of the motor driven dispensers mentioned heretofore and many novel features that result in a new compact motor driven dispenser which is not anticipated, rendered obvious, suggested, or even implied by any of the prior art motor driven dispensers, either alone or in any combination thereof.

To attain this, the present invention generally comprises a housing having a barrel portion and a handle portion. The barrel portion includes a top wall, a bottom wall, a back wall, a front wall, a first side wall and a second side wall. The front wall has a generally circular shaped opening therein. The top wall has an inner surface having a track mounted thereon. A collapsible push rod is positioned in the housing and has a first end and a second end. The second has a head thereon. The push rod includes a plurality of discrete blocks having a top surface, a bottom surface, a back surface, a front surface and a pair of lateral surfaces. Each of the back surfaces has a saddle integrally attached thereto. Each of the front surfaces has boss thereon. Each of the bosses is positioned in and pivotally coupled to one of the saddles such that the blocks are hingedly coupled to each other. The bottom surfaces each have teeth thereon. The push rod is extendably positioned between the track and the top wall such that the push rod abuts the back wall and the second end of the rod extends toward the front wall of the housing in a generally U-shaped configuration. A motor is positioned in the housing. A plurality of drive gears is mechanically coupled to the motor and in communication with the teeth of the push rod. An actuator selectively turns the motor on or off.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new compact motor driven dispenser apparatus and method which has many of the advantages of the motor driven dispensers mentioned heretofore and many novel features that result in a new compact motor driven dispenser which is not anticipated, rendered obvious, suggested, or even implied by any of the prior art motor driven dispensers, either alone or in any combination thereof.

It is another object of the present invention to provide a new compact motor driven dispenser which may be easily and efficiently manufactured and marketed.

It is a further object of the present invention to provide a new compact motor driven dispenser which is of a durable and reliable construction.

An even further object of the present invention is to provide a new compact motor driven dispenser which is susceptible of a low cost of manufacture with regard to both materials and labor, and which accordingly is then susceptible of low prices of sale to the consuming public, thereby making such compact motor driven dispenser economically available to the buying public.

Still yet another object of the present invention is to provide a new compact motor driven dispenser which provides in the apparatuses and methods of the prior art some of the advantages thereof, while simultaneously overcoming some of the disadvantages normally associated therewith.

Still another object of the present invention is to provide a new compact motor driven dispenser for dispensing caulking and glue material.

Yet another object of the present invention is to provide a new compact motor driven dispenser which includes a housing having a barrel portion and a handle portion. The barrel portion includes a top wall, a bottom wall, a back wall, a front wall, a first side wall and a second side wall. The front wall has a generally circular shaped opening therein. The top wall has an inner surface having a track mounted thereon. A collapsible push rod is positioned in the housing and has a first end and a second end. The second has a head thereon. The push rod includes a plurality of discrete blocks having a top surface, a bottom surface, a back surface, a front surface and a pair of lateral surfaces. Each of the back surfaces has a saddle integrally attached thereto. Each of the front surfaces has boss thereon. Each of the bosses is positioned in and pivotally coupled to one of the saddles such that the blocks are hingedly coupled to each other. The bottom surfaces each have teeth thereon. The push rod is extendably positioned between the track and the top wall such that the push rod abuts the back wall and the second end of the rod extends toward the front wall of the housing in a generally U-shaped configuration. A motor is positioned in the housing. A plurality of drive gears is mechanically coupled to the motor and in communication with the teeth of the push rod. An actuator selectively turns the motor on or off.

Still yet another object of the present invention is to provide a new compact motor driven dispenser that has a collapsible push rod so that the device is more compact than convention caulk delivering devices.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
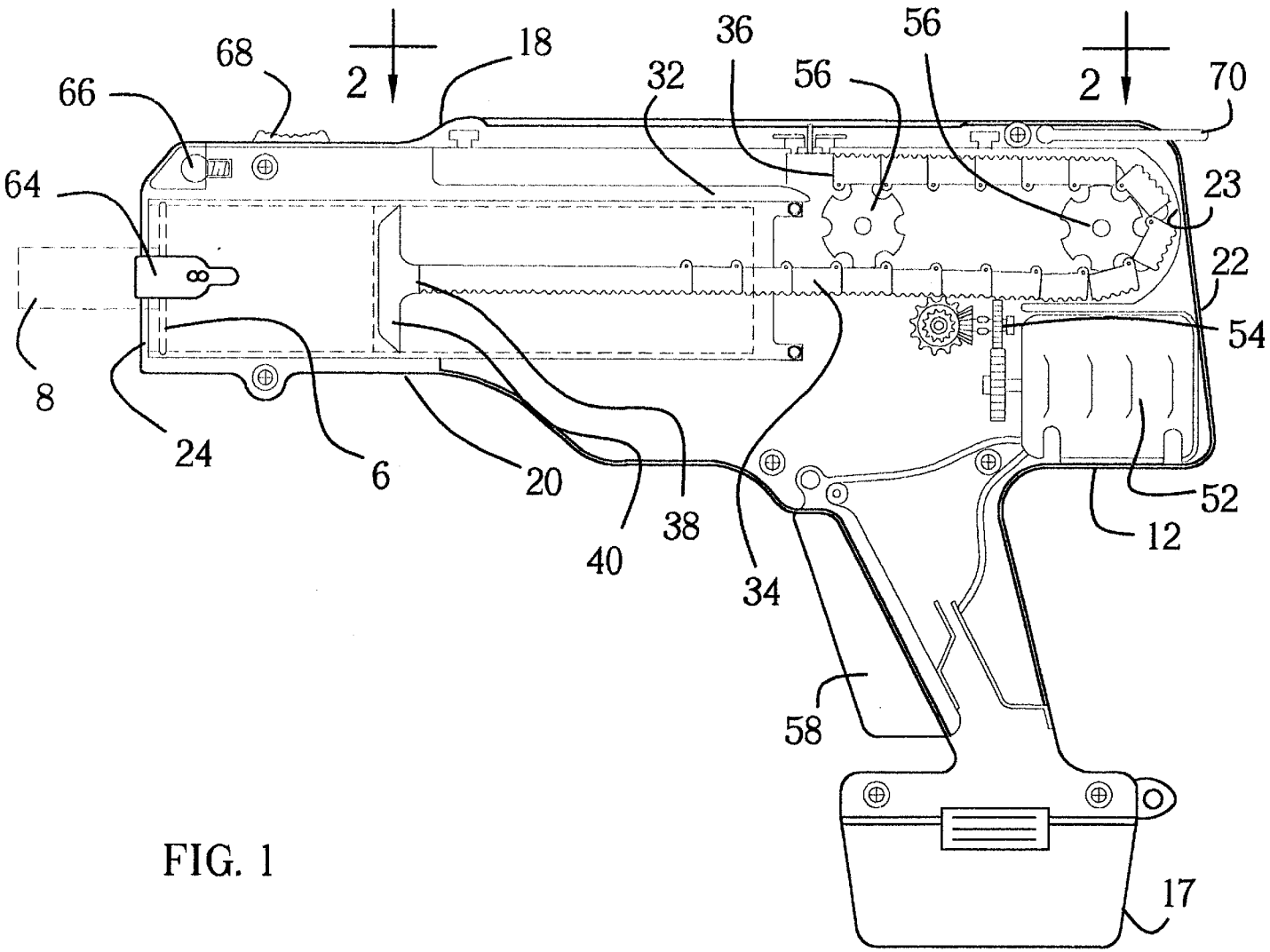
FIG. 1 is a schematic side cross-sectional view of a new compact motor driven dispenser according to the present invention.
Figure 2:
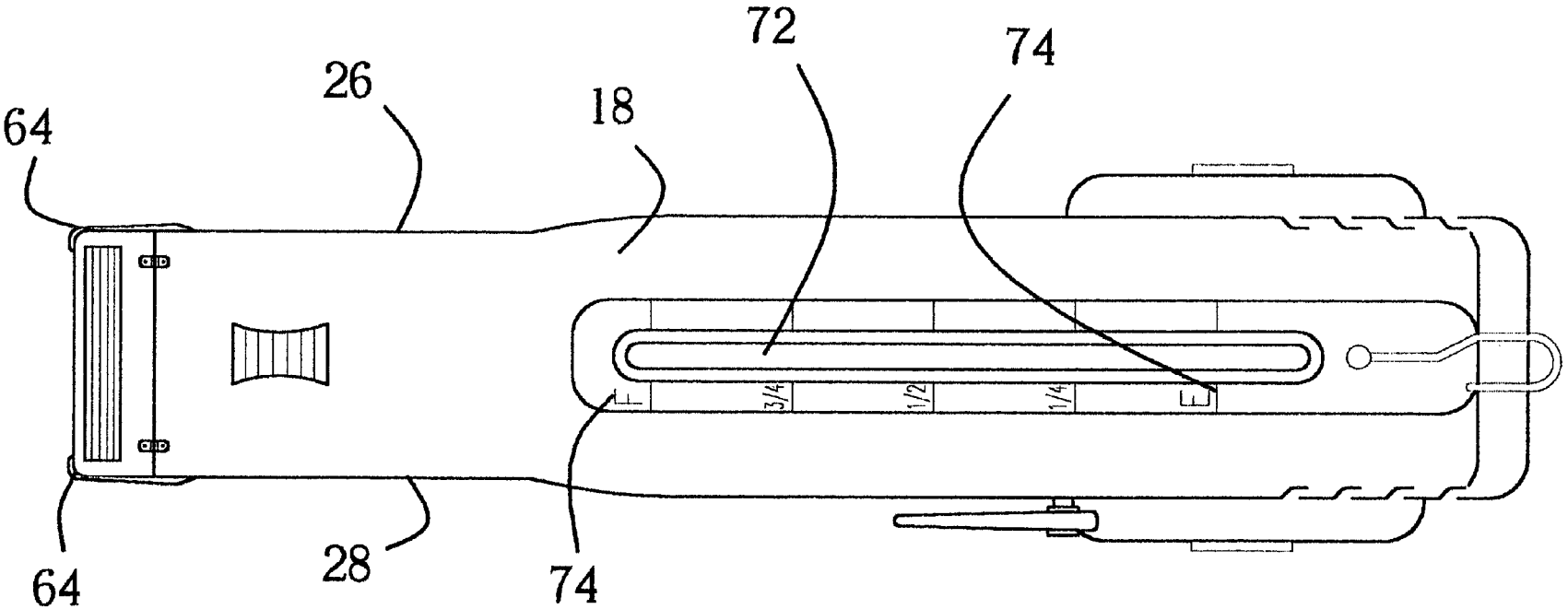
FIG. 2 is a schematic top view of the present invention.
Figure 3:
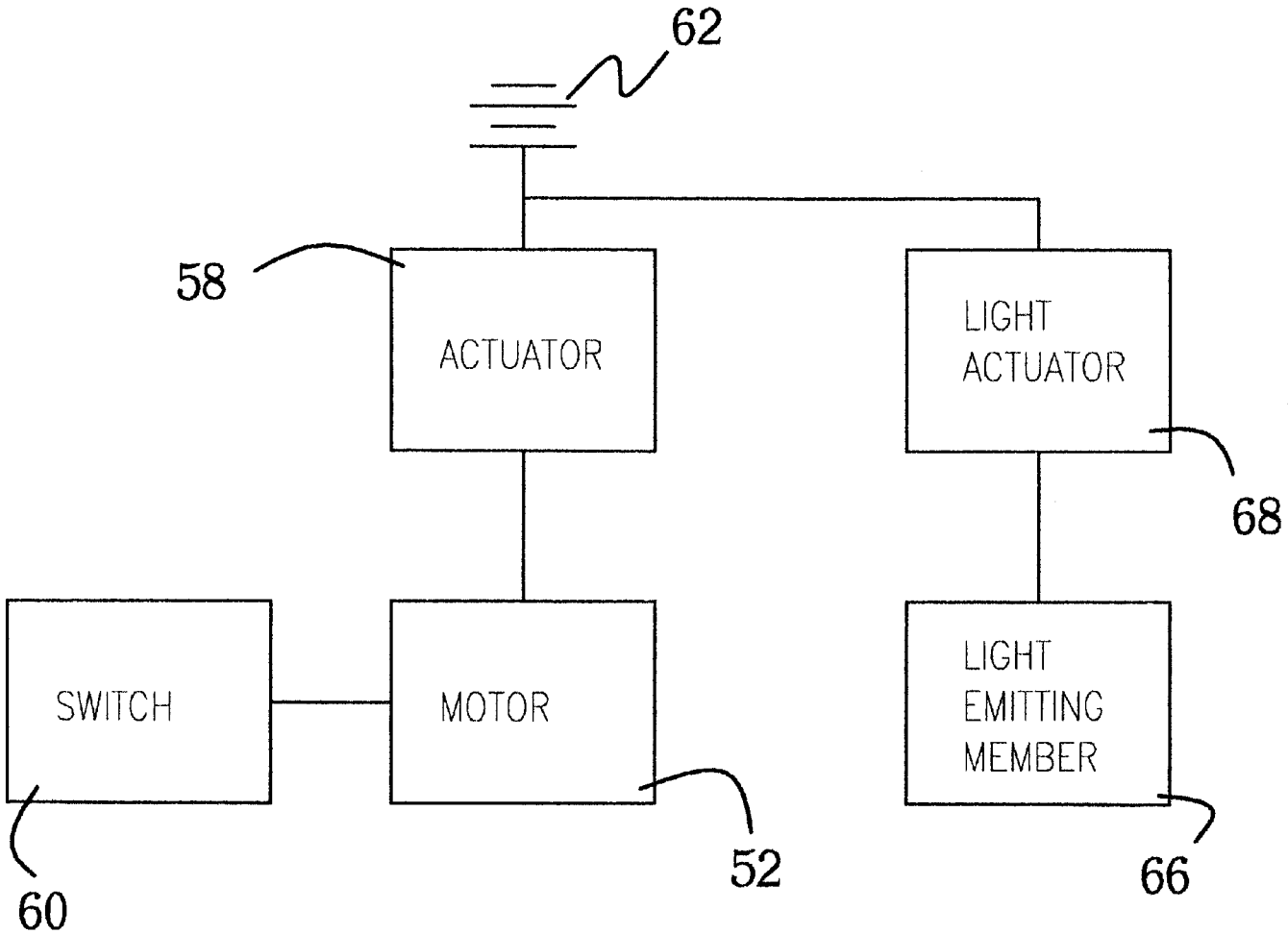
FIG. 3 is a schematic view of the present invention.
Figure 4:
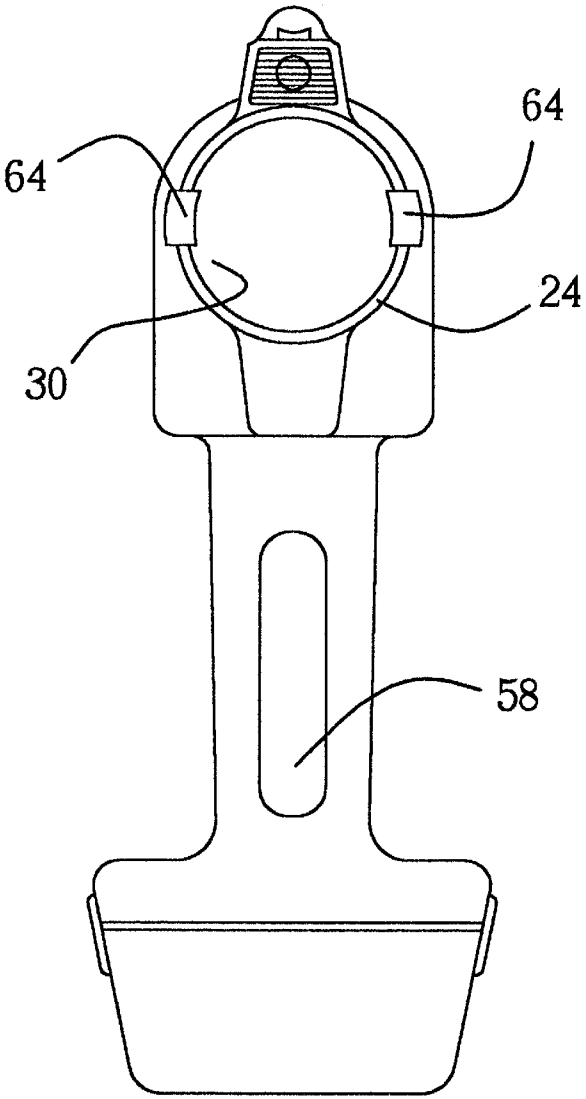
FIG. 4 is a schematic front view of the present invention.
Figure 5:
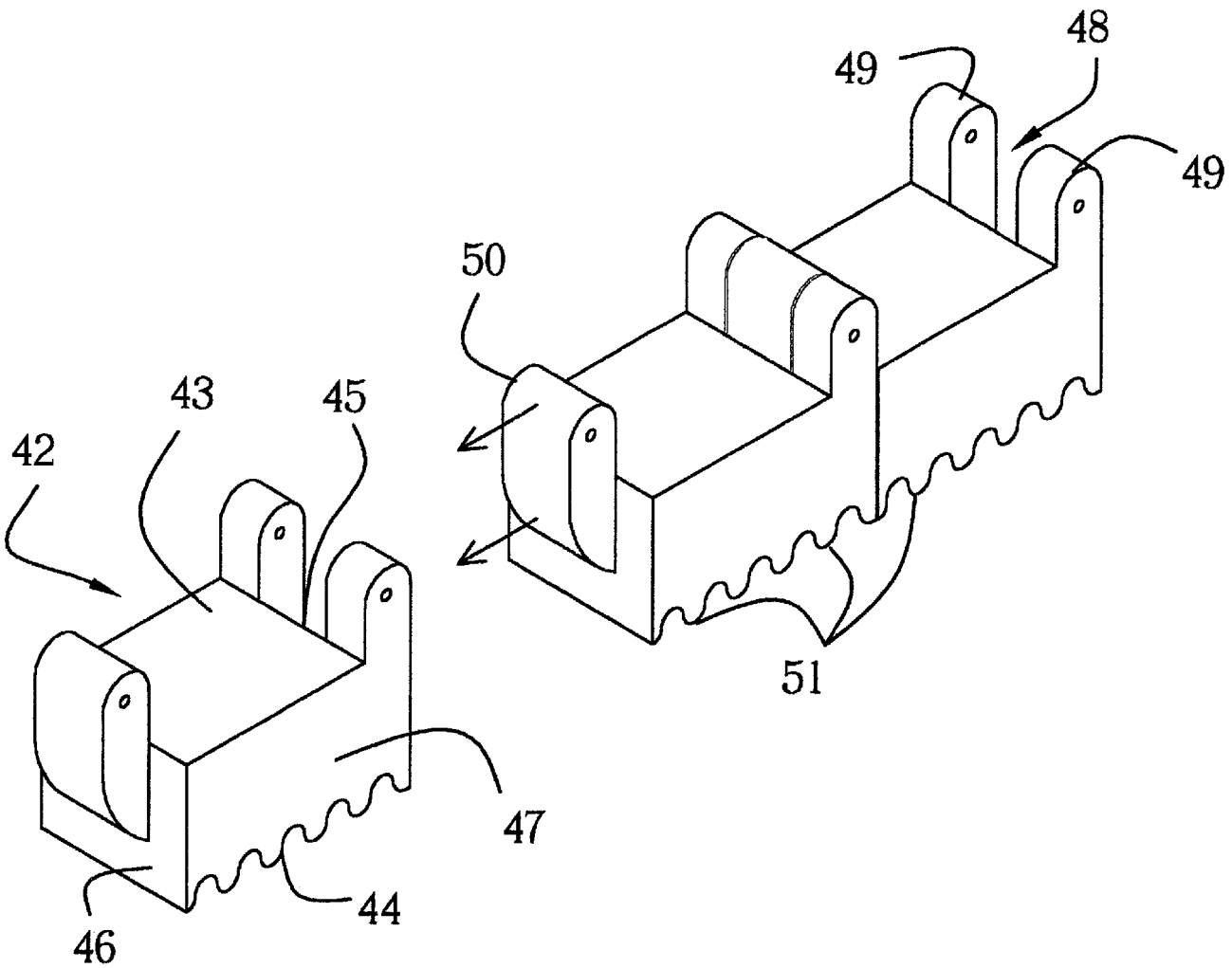
FIG. 5 is a schematic perspective view of the push rod of the present invention.
Figure 6:
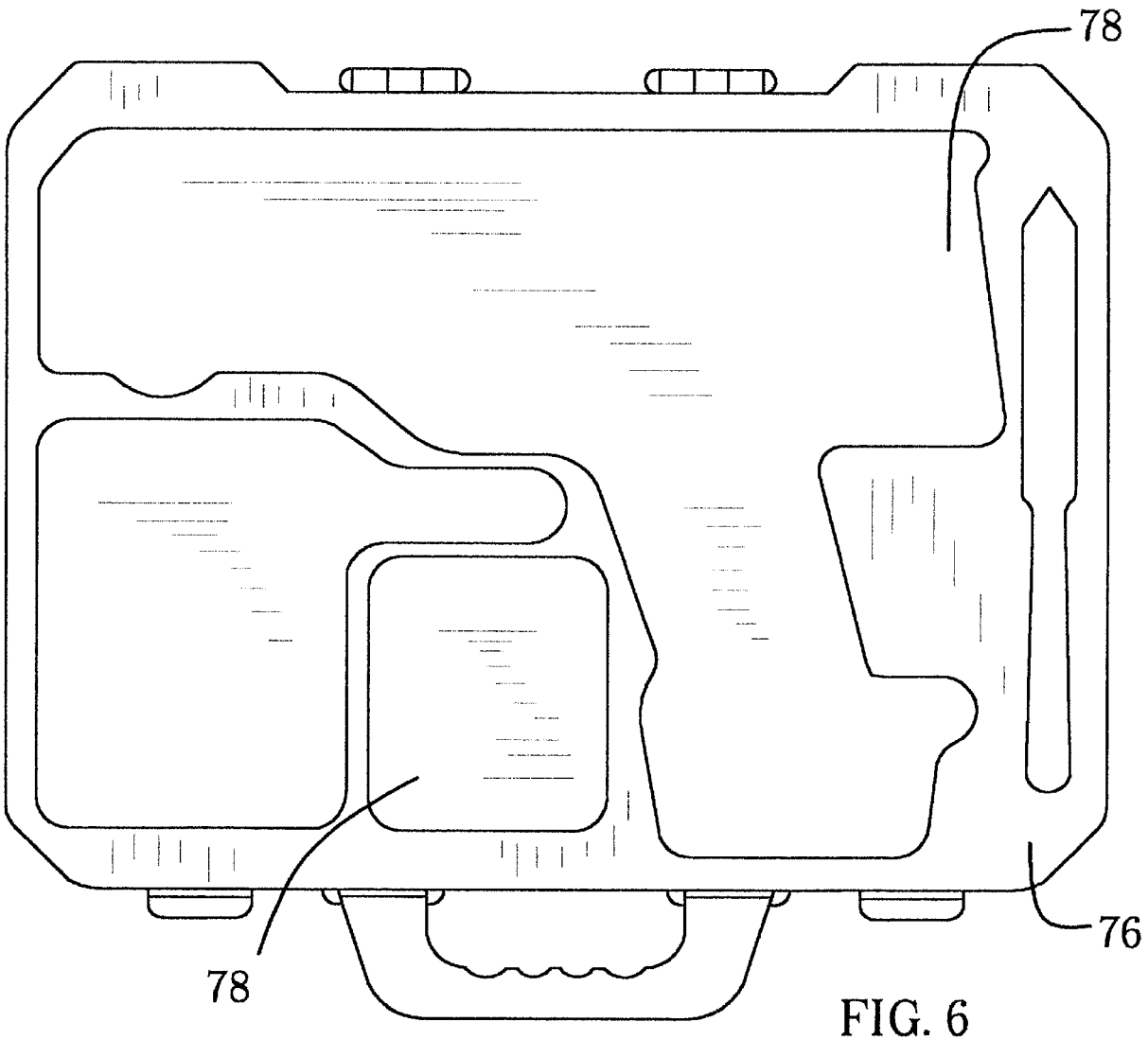
FIG. 6 is a schematic plan view of a case of the present invention.
Figure 7:
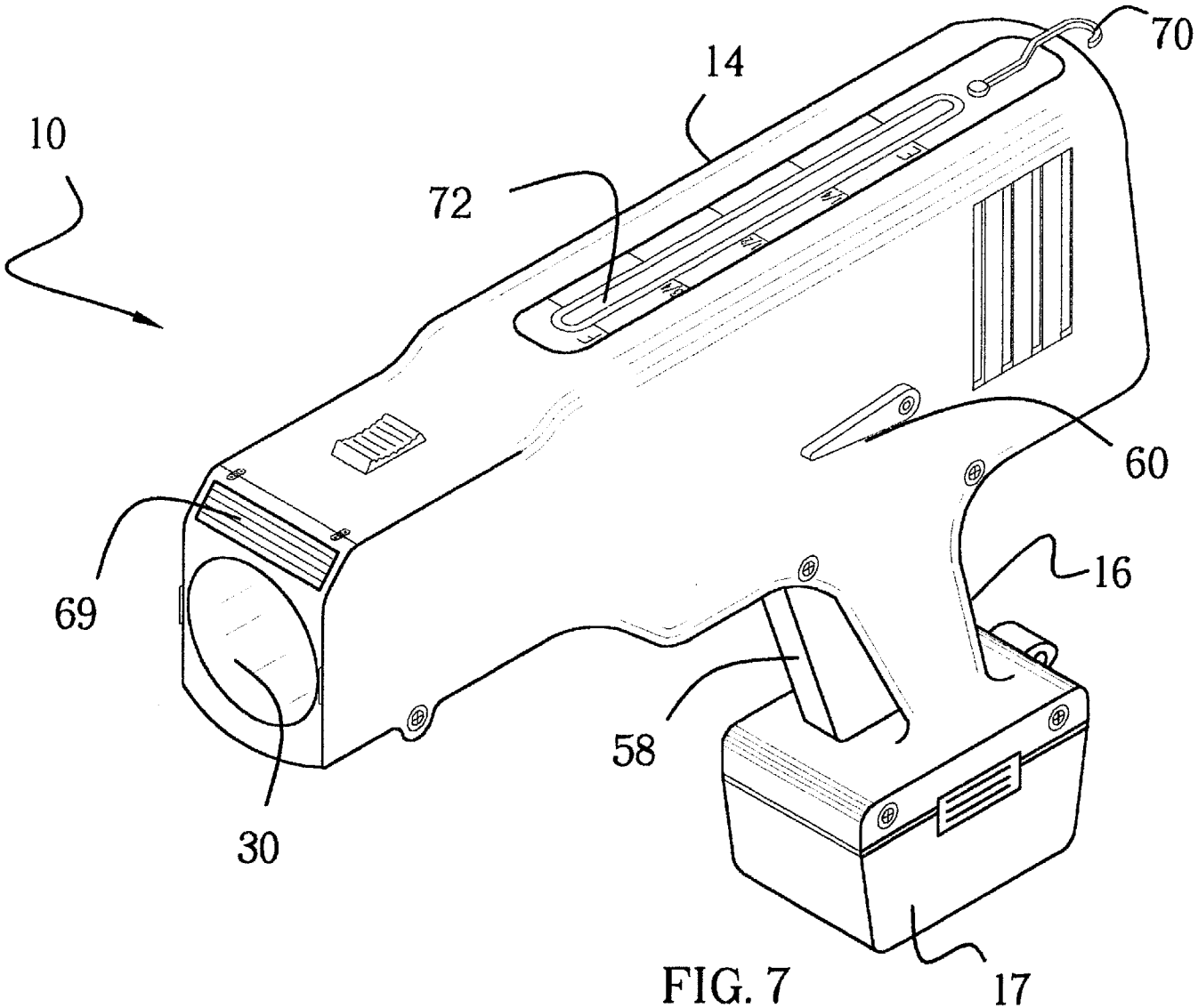
FIG. 7 is a schematic perspective view of the present invention.

With reference now to the drawings, and in particular to FIGS. 1 through 7 thereof, a new compact motor driven dispenser embodying the principles and concepts of the present invention and generally designated by the reference numeral 10 will be described.

As best illustrated in FIGS. 1 through 7, the compact motor driven dispenser 10 generally comprises a housing 12 having a barrel portion 14 and a handle portion 16. The barrel portion 14 includes a top wall 18, a bottom wall 20, a back wall 22, a front wall 24, a first side wall 26 and a second side wall 28. The handle portion 16 is attached to and extends downward from the bottom wall 20. The handle 16 is nearer the back wall 22 than the front wall 24. The front wall 24 has a generally circular shaped opening 30 therein and the back wall 22 has an inner surface 23 having an arcuate shape. The top wall 18 has an inner surface having a track 32 mounted thereon. The track 32 has an opening facing the back wall 22.

A collapsible push rod 34 is positioned in the housing 12 and has a first end 36 and a second end 38. The second end 38 has a head 40 thereon. The push rod 34 includes a plurality of discrete blocks 42 having a top surface 43, a bottom surface 44, a back surface 45, a front surface 46 and a pair of lateral surfaces 47. Each of the back surfaces 45 has a saddle 48 integrally attached thereto defined by a pair of protuberances 49 extending away from the back surface 45. Each of the protuberances 49 extends upwardly. Each of the front surfaces 46 has boss 50 thereon positioned between the lateral surfaces 47 and extending upwardly. Each of the bosses 50 is positioned in one of the saddles 48 when the front surfaces 46 are abutting the protuberances 49 and the top surfaces 43 are generally located in a plane. Each of the bosses 50 is pivotally coupled to one of the saddles 48 such that the blocks 42 are hingedly coupled to each other. The bottom surfaces 44 have teeth 51 thereon extending between the lateral surfaces 47. The push rod 34 is extendably positioned between the track 32 and the top wall 18 such that the push rod 34 abuts the back wall 22 and the second end 38 of the rod 34 extends toward the front wall 24 of the housing 12 in a generally U-shaped configuration. Since the blocks 42 are attached to each other along their top surfaces 43, the rod 34 may only bend in one direction as shown in FIG. 1.

A motor 52 is positioned in the housing 12. The motor 52 being a conventional electric motor used in power tools. Each of a plurality of drive gears 54 is mechanically coupled to the motor 52. At least one of the drive gears 54 in communication with the teeth 51 of the push rod 34 so that the rotational movement of the motor 52 is converted into linear movement of the push rod 34. The motor 52 is adapted for rotating the drive gears 54 in a first direction or a second direction.

At least one guide gear 56 is rotatably positioned in the housing 12 between the top wall 18 and the bottom wall 20. The guide gear 56 is in communication with the top surface 43 of the push rod 34 for guiding the push rod 34 onto the track 32. The push rod 34 is positioned between the drive gears 54 and the guide gear 56. Preferably there are a pair of guide gears 56.

An actuator 58 selectively turns the motor 52 on or off. The actuator 58 is operationally coupled to the motor 52. The actuator 58 is positioned on the handle 16 and extends toward the front wall 24 of the barrel portion 14.

A switch 60 for selecting rotation of the motor 52 in a first direction or a second direction is operationally coupled to the motor 52.

A power supply 62 is operationally coupled to the motor 52. The power supply 62 is removably mounted in a bottom side of the handle 16 and preferably comprises a battery. The bottom side of the handle 16 comprises a door 17 for removing the battery.

Each of a pair of securing members 64 each is attached to one of the side walls 26, 28 of the housing 12. Each of the securing members 64 comprises a clip which is resiliently flexible and retractably extends over the opening 30.

A light emitting member 66 is mounted on the housing 12 and positioned in the front wall 24. The light emitting member 66 comprises a light bulb operationally coupled to the battery 62. A light actuator 68 is operationally coupled to the light emitting member 66 for selectively turning the light emitting member 66 on or off. A generally transparent panel 69 is positioned over the light 66.

A hook 70 is pivotally attached to the top wall 18 and is positioned nearer the back wall 22 than the front wall 24. The hook 70 is used for hanging the housing 12.

An elongated slot 72 extends through the top wall 18 and is oriented generally parallel to a line extending between the front 24 and back 22 walls. The first end 36 of the push rod 34 is viewable through the slot 72. Fill indicia 74 is positioned on the top wall 1 8 and along the slot 72. The user may use the slot 72 for determining how the amount of material left within a canister 6.

Preferably a casing 76 is included having depressions 78 therein having shapes therein adapted for holding the housing 12, additional batteries and other utensils which would be useful.

In use, a conventional caulking canister 6, or other glue canister, is extended through the opening 30 and into the housing 12. The head 40 abuts the canister 6 and forces material within the canister out of the canister through its tip 8. The securing members 64 are used for holding the canister 6 in the housing 12. When the canister is empty, the motor 52 may be placed in reverse to retract the head 40 from the opening 30 so that another canister 6 may be positioned in the housing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A motor driven caulking gun comprising:

a housing having a barrel portion and a handle portion, said barrel portion including a top wall, a bottom wall, a back wall, a front wall, a first side wall and a second side wall, said handle portion being attached to and extending downward from said bottom wall, said front wall having a generally circular shaped opening therein, said top wall having an inner surface having a track mounted thereon;

a collapsible push rod being positioned in said housing and having a first end and a second end, said second end having a head thereon, said push rod including a plurality of discrete blocks having a top surface, a bottom surface, a back surface, a front surface and a pair of lateral surfaces, each of said back surfaces having a saddle integrally attached thereto, each of said front surfaces having boss thereon, each of said bosses being positioned in and pivotally coupled to one of said saddles such that said blocks are hingedly coupled to each other, each of said bottom surfaces having teeth thereon extending between said lateral surfaces, said push rod being extendably positioned between said track and said top wall such that said push rod abuts said back wall and said second end of said rod extends toward said front wall of said housing in a generally U-shaped configuration;

a motor being positioned in said housing;

a plurality of drive gears being mechanically coupled to said motor and in communication with said teeth of said push rod; and an actuator for selectively turning said motor on or off, said actuator being operationally coupled to said motor.

2. The motor driven caulking gun as in claim 1, wherein said back wall has an inner surface having an arcuate shape.

3. The motor driven caulking gun as in claim 1, wherein each of said saddles is defined by a pair of protuberances extending away from said back surface, each of said protuberances extending upwardly, each of said bosses being positioned between said lateral surfaces and extending upwardly, each of said bosses being positioned in one of said saddles when said front surfaces are abutting said protuberances and said top surfaces are generally located in a plane.

4. The motor driven caulking gun as in claim 1, further including at least one guide gear being rotatably positioned in said housing between said top wall and said bottom wall, said guide gear being in communication with said top surface of said push rod for guiding said push rod onto said track, said push rod being positioned between said drive gears and said guide gear.

5. The motor driven caulking gun as in claim 1, further including a switch for selecting rotation of said motor in a first direction or a second direction, said switch being operationally coupled to said motor.

6. The motor driven caulking gun as in claim 1, further including a power supply being operationally coupled to said motor, said power supply being removably mounted in a bottom side of said handle and comprising a battery.

7. The motor driven caulking gun as in claim 6, further including a pair of securing members each being attached to one of said side walls of said housing and retractably extending over said opening.

8. The motor driven caulking gun as in claim 1, further including a pair of securing members each being attached to one of said side walls of said housing and retractably extending over said opening.

9. The motor driven caulking gun as in claim 1, further including a light emitting member being mounted on said housing and positioned in said front wall.

10. The motor driven caulking gun as in claim 9, further including a light actuator being operationally coupled to said light for selectively turning said light emitting member on or off.

11. The motor driven caulking gun as in claim 9, further including a hook being pivotally attached to said top wall and being positioned nearer said back wall than said front wall.

12. The motor driven caulking gun as in claim 1, further including a hook being pivotally attached to said top wall and being positioned nearer said back wall than said front wall.

13. The motor driven caulking gun as in claim 1, further including an elongated slot extending through said top wall and being oriented generally parallel to a line extending between said front and back walls, said first end of said push rod being viewable through said slot.

14. The motor driven caulking gun as in claim 13, further including fill indicia being positioned on said top wall and along said slot.

15. A motor driven caulking gun comprising:

a housing having a barrel portion and a handle portion, said barrel portion including a top wall, a bottom wall, a back wall, a front wall, a first side wall and a second side wall, said handle portion being attached to and extending downward from said bottom wall, said handle being nearer said back wall than said front wall, said front wall having a generally circular shaped opening therein, said back wall having an inner surface having an arcuate shape, said top wall having an inner surface having a track mounted thereon, said track having an opening facing said back wall;

a collapsible push rod being positioned in said housing and having a first end and a second end, said second end having a head thereon, said push rod including a plurality of discrete blocks having a top surface, a bottom surface, a back surface, a front surface and a pair of lateral surfaces, each of said back surfaces having a saddle integrally attached thereto defined by a pair of protuberances extending away from said back surface, each of said protuberances extending upwardly, each of said front surfaces having boss thereon, each of said bosses being positioned between said lateral surfaces and extending upwardly, each of said bosses being positioned in one of said saddles when said front surfaces are abutting said protuberances and said top surfaces are generally located in a plane, each of said bosses being pivotally coupled to one of said saddles such that said blocks are hingedly coupled to each other, each of said bottom surfaces having teeth thereon extending between said lateral surfaces, said push rod being extendably positioned between said track and said top wall such that said push rod abuts said back wall and said second end of said rod extends toward said front wall of said housing in a generally U-shaped configuration;

a motor being positioned in said housing;

a plurality of drive gears being mechanically coupled to said motor and in communication with said teeth of said push rod;

at least one guide gear being rotatably positioned in said housing between said top wall and said bottom wall, said guide gear being in communication with said top surface of said push rod for guiding said push rod onto said track, said push rod being positioned between said drive gears and said guide gear;

an actuator for selectively turning said motor on or off, said actuator being operationally coupled to said motor, said actuator being positioned on said handle;

a switch for selecting rotation of said motor in a first direction or a second direction, said switch being operationally coupled to said motor;

a power supply being operationally coupled to said motor, said power supply being removably mounted in a bottom side of said handle and comprising a battery;

a pair of securing members each being attached to one of said side walls of said housing and retractably extending over said opening;

a light emitting member being mounted on said housing and positioned in said front wall, said light emitting member comprising a light bulb operationally coupled to said battery, a light actuator being operationally coupled to said light for selectively turning said light emitting member on or off;

a hook being pivotally attached to said top wall and being positioned nearer said back wall than said front wall;

an elongated slot extending through said top wall and being oriented generally parallel to a line extending between said front and back walls, said first end of said push rod being viewable through said slot, fill indicia being positioned on said top wall and along said slot.

* * * * *